US005491852A

United States Patent [19]

Maucher

[11] Patent Number: 5,491,852

[45] Date of Patent: Feb. 20, 1996

[54] MATTRESSES AND CHAISE LONGUE CUSHIONS HAVING A CORE MADE OF FLEXIBLE POLYURETHANE FOAM

[75] Inventor: Helmut Maucher, Langenau, Germany

[73] Assignee: Koepf Aktiengesellschaft, Germany

[21] Appl. No.: 278,219

[22] Filed: Jul. 21, 1994

[51] Int. Cl.[6] ..... A47C 27/14

[52] U.S. Cl. ..... 5/481; 5/468

[58] Field of Search ..... 5/481, 901, 468, 5/469, 423

[56] References Cited

U.S. PATENT DOCUMENTS

| | | | |
|---|---|---|---|
| 3,222,698 | 12/1965 | Levenson | 5/481 |
| 3,885,257 | 5/1975 | Rogers | 5/901 |
| 4,110,881 | 9/1978 | Thompson | 5/481 |
| 4,383,342 | 5/1983 | Forster | 5/464 |
| 4,524,473 | 6/1985 | Fanti | 5/481 |
| 5,007,124 | 4/1991 | Raburn et al. | 5/481 |
| 5,083,335 | 1/1992 | Krouskop et al. | 5/481 |
| 5,111,542 | 5/1992 | Farley | 5/481 |
| 5,115,527 | 5/1992 | Medley | 5/481 |
| 5,211,697 | 5/1993 | Kienlein et al. | 5/901 |
| 5,252,278 | 10/1993 | Spann et al. | 5/481 |

*Primary Examiner*—Michael J. Milano
*Attorney, Agent, or Firm*—Banner & Allegretti, Ltd.

[57] ABSTRACT

Mattresses and chaise longue cushions made of a core made of flexible polyurethane foam having two groups of rows perpendicular to the longitudinal axis of the core of continuous cavities each having an elongated cross section. Each of the elongated cross sections from about the center of the longitudinal axis of the core towards the end thereof is arranged in an oblique orientation relative to the mattress height. Between the two groups of rows of continuous cavities there is present one continuous cavity in a symmetric non-oblique orientation. This arrangement causes the vertebral column to be stretched and, hence, due to movements on the mattress or chaise lounge cushion, results in kind of vertebral column physical exercises producing some stretching effect.

7 Claims, 5 Drawing Sheets

MATTRESSES AND CHAISE LONGUE CUSHIONS HAVING A CORE MADE OF FLEXIBLE POLYURETHANE FOAM

BACKGROUND OF THE INVENTION

The present invention relates to mattresses and chaise longue cushions having a core of flexible polyurethane foam.

Many maladies and diseases of the back and of the vertebral column altogether are the result of too much strain in the course of the day and too little relief during the night and rest hours. Many of these infirmities can be avoided or, if already manifest, be alleviated or healed by providing an at least temporary relief by remedial exercises, gymnastic exercises and especially stretching exercises. However, as a matter of fact, by far not all of those persons make use of such exercises who urgently should do stretching exercises on the account of their maladies of the back and vertebral column.

DE 89 11 726 U1 describes a mattress comprising matching incisions formed as notches. The upper edge of the mattress also is always cut into. This step is taken in order to increase the point elasticity and to provide the repose area when laid upon with a softer impression without changing or decreasing the characteristic features and the cushioning property thereof.

US-A-4,134,166 describes a mattress comprising circular drill holes into which flexible tubes have been inserted. Also, this mattress is intended to provide a more comfortable rest and to make the properties variable by different air pressures within the tubes.

DE 92 01 392 U1 describes a mattress similar to that disclosed in DE 89 11 726 U1. Also this mattress is intended to accommodate to the anatomic conditions of the human body lying thereon. However, no indication is found that this mattress would also cause the body of the person lying thereon to be stretched. Nor is this previously described mattress capable of causing such an effect.

SUMMARY OF THE INVENTION

It is the primary object of the invention to develop mattresses and chaise longue cushions which, due to the specific shape thereof, produce an automatic stretching in the longitudinal direction of the body and, thus, result in that without any intentional cooperation of the person lying on such mattress or chaise longue cushion the body of this person will be stretched in the longitudinal direction.

According to the invention, this object can be attained by mattresses and chaise longue cushions comprising a core made of flexible polyurethane foam comprising two groups of rows perpendicular to the longitudinal axis of the core of continuous cavities each having an elongated cross section, with each of the elongated cross sections from about the center of the longitudinal axis of the core towards the end thereof being arranged in an oblique orientation relative to the mattress height and one row of a continuous cavity in a symmetric non-oblique orientation being present in about the center of the longitudinal axis of the core between the two groups of rows of continuous cavities.

The uppermost portion of each cavity is beneath the upper surface of the core and the lower portion of each cavity is above the lower surface of the core, such that each cavity is substantially enclosed between the upper and lower surfaces of the core, and does not extend entirely through either of those surfaces.

The elongated cross sections preferably are elliptical or oval or rectangular in shape, in which latter case the corners may be rounded off.

The stretching effect may be enhanced by providing the surface of the core with incisions over the positions of the bridges between two adjacent cavities.

When a person rests on mattresses and chaise longue cushions according to the present invention, the mattresses and chaise longue cushions, under the action of the weight of the person, produce some stretching effect, namely towards the head of the person in the head portion of the mattress and towards the feet of the person at the foot end portion of the mattress. The incisions which are preferred to be additionally provided on the surface of core will increase the extensibility of the surface so that a higher tension is applied towards both the head and the feet and thereby the vertebral column altogether is stretched and relieved.

Upon any motion, deliberate or asleep, the elastic flexible polyurethane foam will straighten up again and return in its configuration and then will exert a tensile force anew onto the vertebral column, thereby providing an effect similar to that caused by vertebral column physical exercises.

Furthermore, in the course of each load/ease cycle the air present in the cavities and cells is discharged in a lateral direction and exchanged. This results in a ventilation and, thus, also in venting the air moistened by body moisture. Thus, the cavities are steadily supplied with fresh air alone by the movement of the person who is resting or asleep. This additional ventilation of the mattress produces a more healthy and comfortable sleeping environment.

The cavities provided according to the invention in the flexible polurethane foam core may be produced by controlled cutting devices comprising a rotating or oscillating knife. It is further possible to cut the cavities using a hot wire. Devices for cutting cavities in flexible polurethane foam are already commercially available, while they so far have been used for entirely different purposes. Suitable machines can be obtained, for example, by the companies Frecken in Kirfel, Germany, and Bäumer OFS, Germany.

The amount of stretching is dependent on the size and dimensions of the continuous cavities. Preferred dimensions are cross sections of from 3 to 12 cm in length and from 1 to 3 cm in width. Between the two groups of rows of cavities there may be cut a circular cavity preferably having a diameter of from 2 to 6 cm. The incisions on the surface of the core may be round or angular. Maximum incision depths of from 0.5 to 3 cm are well suitable. The inclination angle in general is chosen to be between 30° and 60°. An inclination angle of 45° is preferred.

DESCRIPTION OF THE PREFERRED EMBODIMENTS

Figure 1:
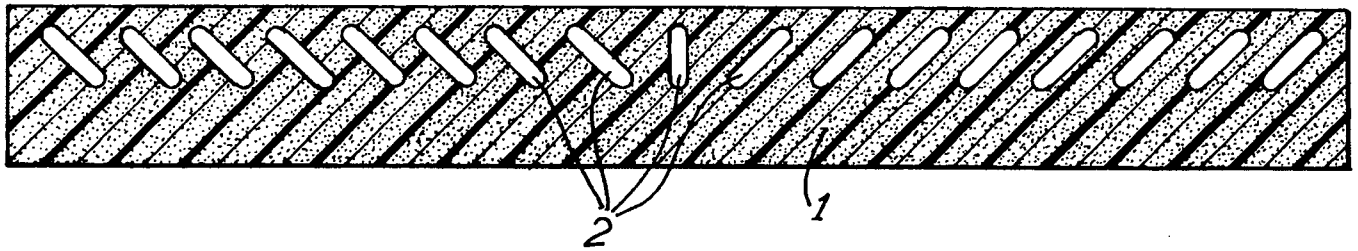
FIG. 1 is a front elevational view in cross-section of the core of a mattress according to the invention.
Figure 2:
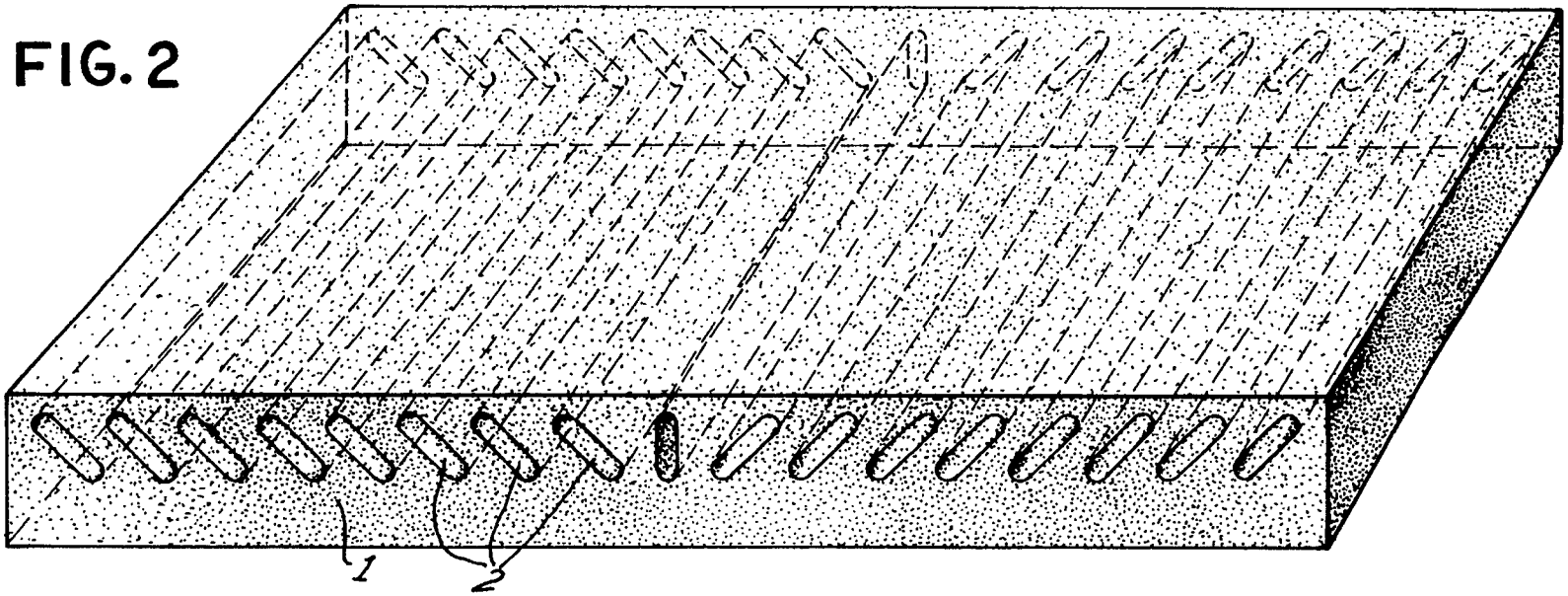
FIG. 2 is a perspective view of the core of a mattress according to the invention.

Referring first to FIGS. 1 and 2, there is shown a mattress core comprising a polyurethane foam core 1 with transverse cavities 2. The cavities 2 are arranged in two groups of rows 5 and 6 perpendicular to the longitudinal axis of the core and one continuous cavity 7 in a symmetric non-oblique orientation being present in about the center of the longitudinal axis of the core between the two groups of rows of continuous cavities. The cavities are continuous each having an elongated cross-section, with each of the elongated cross-sections from about the center of the longitudinal axis of the core towards the end thereof being arranged in an oblique orientation relative to the mattress height.

Figure 3:
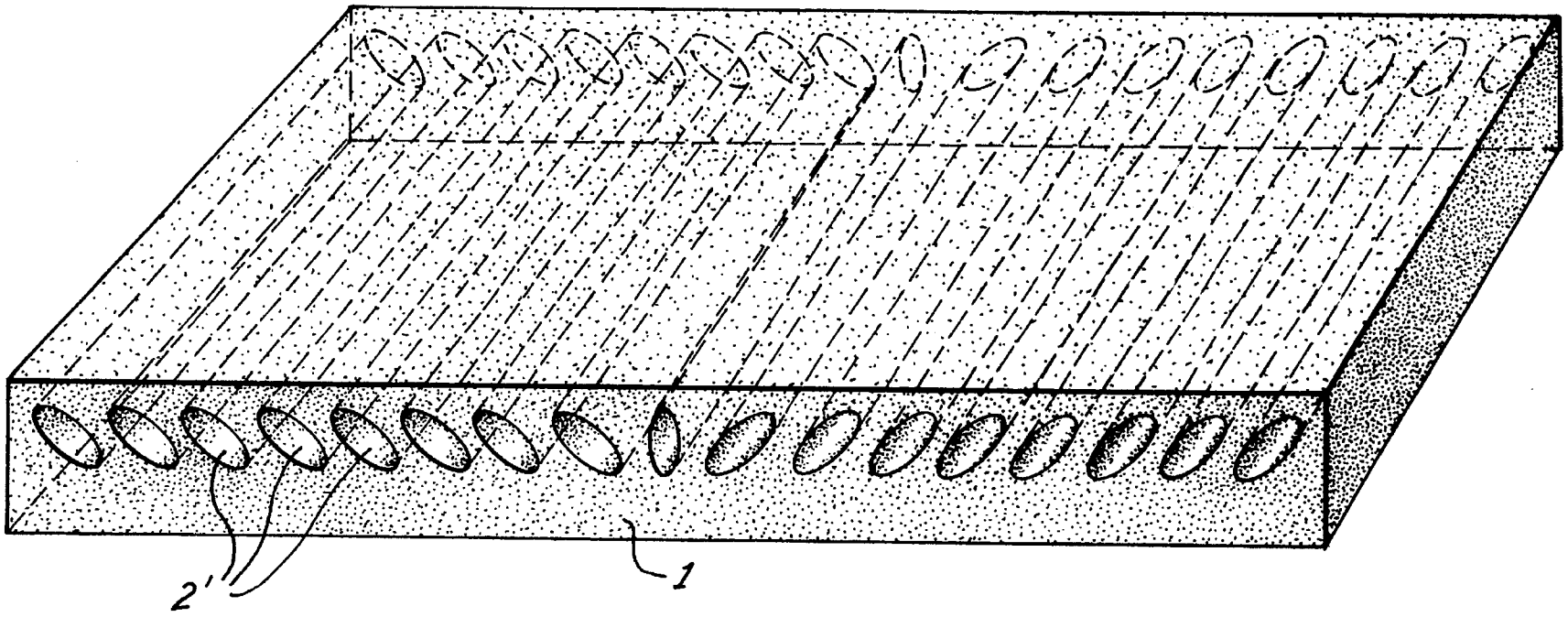
FIG. 3 shows the core of a mattress with cavities which are oval or elliptical.

In an alternate embodiment, as shown in FIG. 3, the cavities 2 are elliptical or oval in cross-section.

Figure 4:
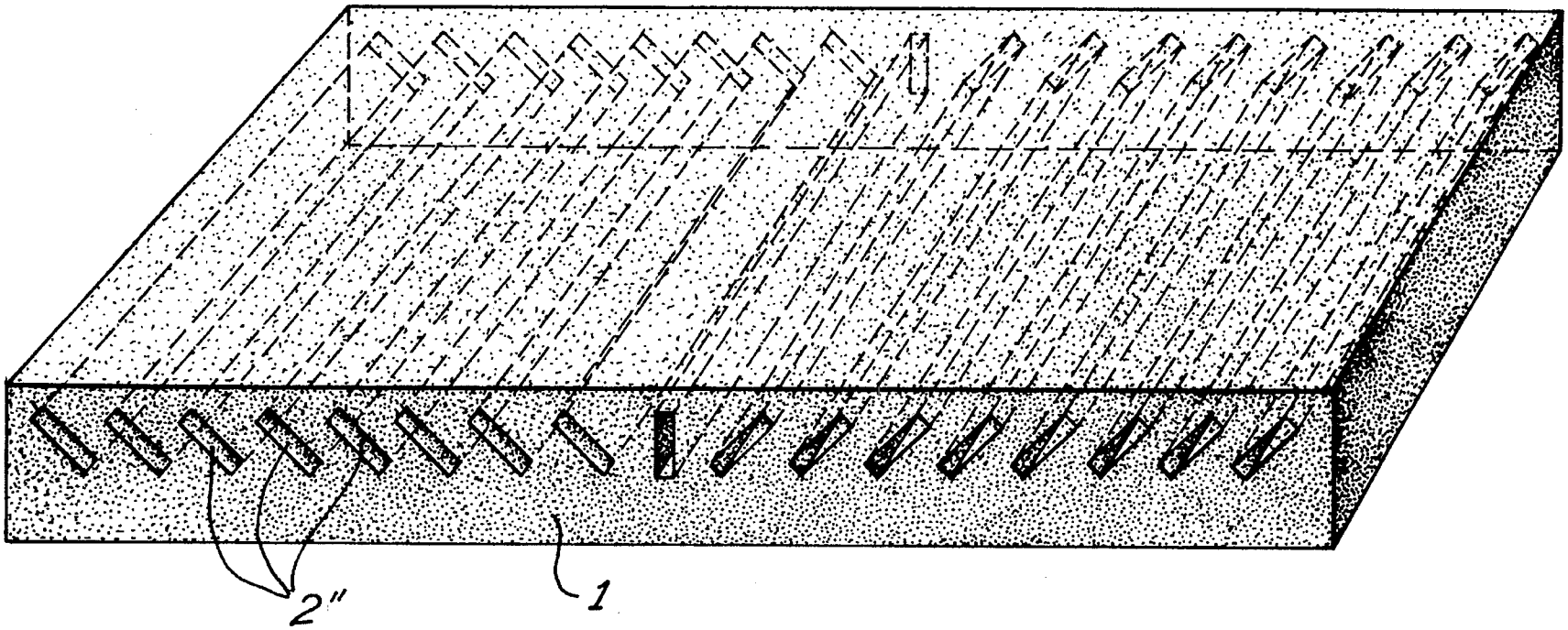
FIG. 4 shows the core of a mattress with cavities which are rectangular.

In another embodiment, as shown in FIG. 4, the cavities are rectangular in cross-section.

Figure 5:
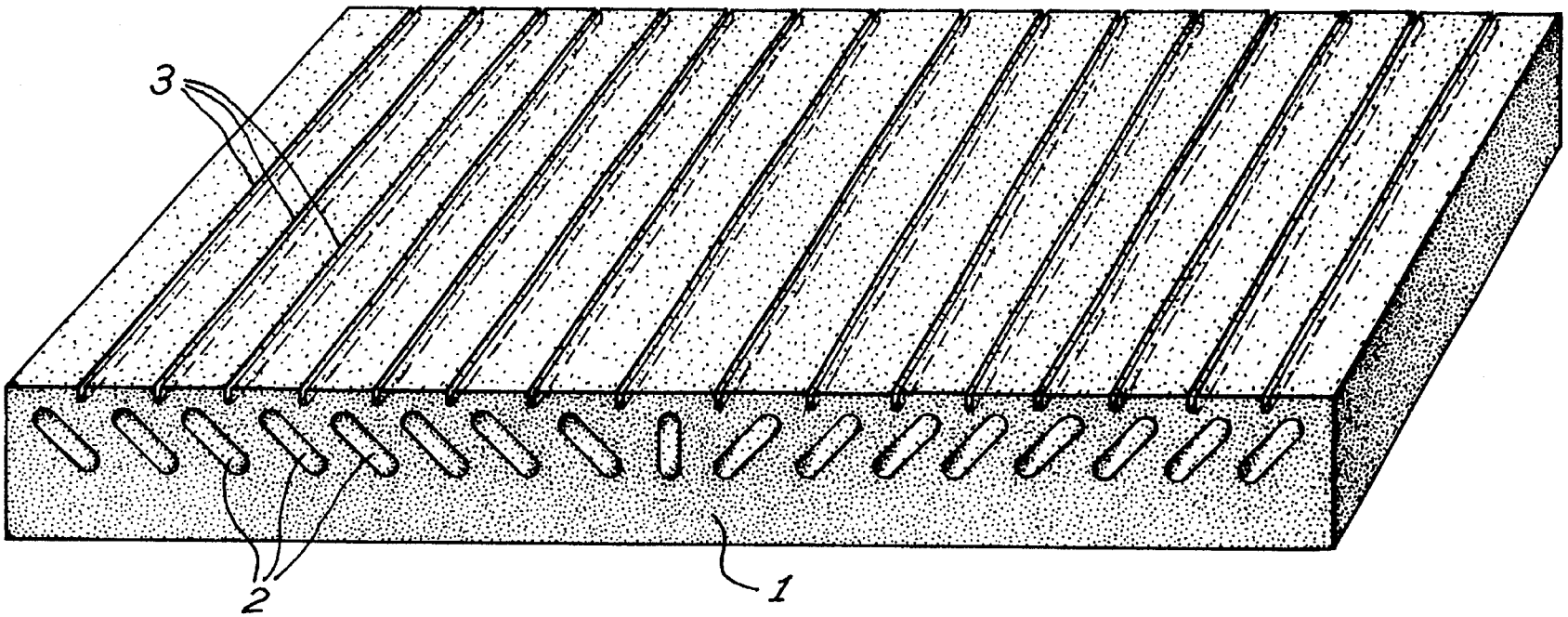
FIG. 5 shows the core of a mattress provided with incisions over the positions of the bridges between two adjacent cavities.

As shown in FIG. 5, in a preferred embodiment, the surface of the core 1 is provided with incisions 3 over the positions of the bridges between two adjacent cavities 2.

Figure 6:
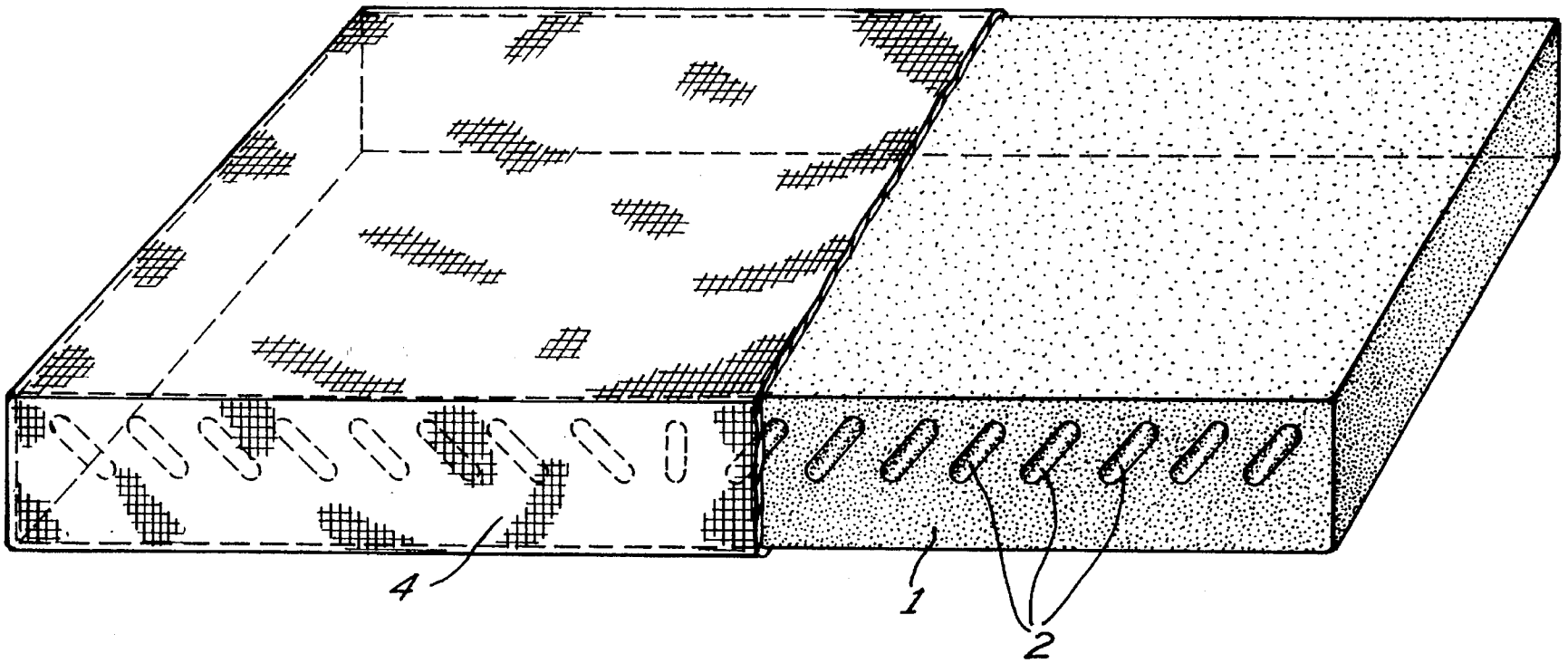
FIG. 6 shows a mattress which is covered with the usual outer layer.

The core 1 can be provided with a conventional cover 4 as shown in FIG. 6.

What is claimed is:

1. A mattress or chaise longue cushion comprising a core made of flexible polyurethane foam, said core having upper and lower surfaces and having two groups of rows of continuous cavities arranged within the core transversely perpendicular to the longitudinal axis of said core, each cavity having an elongated cross section, with each of said elongated cross sections from about the center of the longitudinal axis of said core towards the end thereof being arranged in an oblique orientation relative to the mattress height and one row of a continuous cavity in about the center of the longitudinal axis of said core between said two groups of continuous cavities, the upper portion of each cavity being beneath the upper surface of the core and the lowermost portion of each cavity being above the lower surface of the core, such that each cavity is enclosed between the upper and lower surfaces of the core along substantially an entire length of the cavity.

2. The mattress or chaise longue cushion according to claim 1, further comprising incisions on the surface of said core over the positions of the bridges between two adjacent cavities.

3. The mattress or chaise longue cushion according to claim 1, wherein said elongated cross sections are elliptical or oval in shape.

4. The mattress or chaise longue cushion according to claim 3, further comprising incisions on the surface of said core over the positions of the bridges between two adjacent cavities.

5. The cushion according to claim 1, wherein said elongated cross sections are rectangular in shape.

6. The cushion according to claim 5, wherein the corners of said rectangular elongated cross-sections are rounded off.

7. The cushion according to claim 5, further comprising incisions on the surface of said core over the positions of the bridges between two adjacent cavities.

* * * * *